United States Patent [19]

Kando et al.

[11] 4,118,839

[45] Oct. 10, 1978

[54] RETAINING DEVICE FOR CONCEALED SLIDE FASTENER

[75] Inventors: Akiyoshi Kando, Uozu; Kiyoo Yoneya, Kurobe, both of Japan

[73] Assignee: Yoshida Kogyo K.K., Japan

[21] Appl. No.: 788,918

[22] Filed: Apr. 19, 1977

[30] Foreign Application Priority Data

Apr. 23, 1976 [JP] Japan ..... 51/51678[U]

[51] Int. Cl.[2] ..... A44B 19/26; A44B 19/34

[52] U.S. Cl. ..... 24/205.1 R; 24/205 R; 24/205.15 R

[58] Field of Search ..... 24/205.1 R, 205.15 R

[56] References Cited

U.S. PATENT DOCUMENTS

| | | | |
|---|---|---|---|
| 1,609,081 | 11/1926 | Freysinger | 24/205.15 R |
| 3,011,238 | 12/1961 | McNamara | 24/205.1 R |
| 3,324,523 | 6/1967 | Mulka | 24/205.1 R |
| 4,000,546 | 1/1977 | Takamatsu | 24/205.1 R |

*Primary Examiner*—Bernard A. Gelak

*Attorney, Agent, or Firm*—Bucknam and Archer

[57] ABSTRACT

A retaining device for retaining a terminal end portion of a so-called concealed slide fastener in closed disposition against accidental splitting or disengagement of the intermeshed fastener elements at the end portion. The retaining device has a base; a pair of opposed inwardly directed longitudinal flanges having vertical side walls and horizontal upper walls having their longitudinal edges disposed in spaced, confronting relationship; and a pair of symmetrical projections at one end of the device each extending integrally with the respective horizontal walls beyond the end of each of the side walls. The pair of opposed inwardly directed longitudinal flanges define with the base a channel functionally analogous to that of a slider.

4 Claims, 5 Drawing Figures

RETAINING DEVICE FOR CONCEALED SLIDE FASTENER

BACKGROUND OF THE INVENTION

1. Field of the Invention

This invention relates to a slide fastener and has particular reference to a retaining device for retaining a terminal end portion of the fastener in closed disposition against accidental splitting or disengagement of the fastener elements that have been intermeshed at the end portion.

The retaining device under contemplation is intended for use particularly on and for a slider-operated fastener of the so-called "concealed" or "masked" type which in its closed disposition substantially simulates a garment seam.

Slide fasteners having two rows of interlocking fastener elements formed from a continuous filament or wire and secured to respective folded edges of opposed stringer tapes are well known, and such fasteners when closed by the slider mask the elements from external view, only leaving a linear seam in the junction of the opposed tapes.

The so-called "concealed" or "masked" slide fasteners of known type are designed to maintain the effect of concealing or masking the fastener elements by folding the respective element-carrying edges of the stringer tapes on themselves about the sewn seams which extend longitudinally of the tapes and secure the respective rows of fastener elements to the tapes.

2. Prior Art

Known slide fasteners of this description are equipped with such sliders which have stoppers or retainers adapted to hold the fastener elements in coupled condition against accidental separation at a terminal end of the fastener. However, after the slider is removed from the fastener, the fastener stringers are liable to separate or disengage from each other when subjected to lateral stresses at their terminal ends.

SUMMARY OF THE INVENTION

With the above drawback of the prior art in view, it is the primary object of the invention to provide an improved retaining device for slide fasteners which will ensure maintenance of the coupled or closed disposition of paired fastener stringers upon and after removal of a slider from either terminal end of the fastener.

Another and related object of the present invention is to provide an improved retaining device which can be mounted on and dismounted from the rows of interlocking fastener elements with utmost ease.

According to this invention, a retaining device for concealed slide fasteners having folded stringers is provided having a base, a pair of opposed inwardly directed longitudinal flanges having vertical side walls and horizontal upper walls having their longitudinal edges disposed in spaced, confronting relationship, and a pair of symmetrical projections at one end of the device each extending integrally with the respective horizontal walls beyond the end of each of the side walls; the pair of opposed inwardly directed longitudinal flanges define with the base a channel functionally analogous to that of a slider.

The invention will be better understood from the following description taken in connection with the accompanying drawings which illustrate by way of example certain preferred embodiments which the invention may assume in practice.

DETAILED DESCRIPTION OF THE PREFERRED EMBODIMENTS

Figure 2:
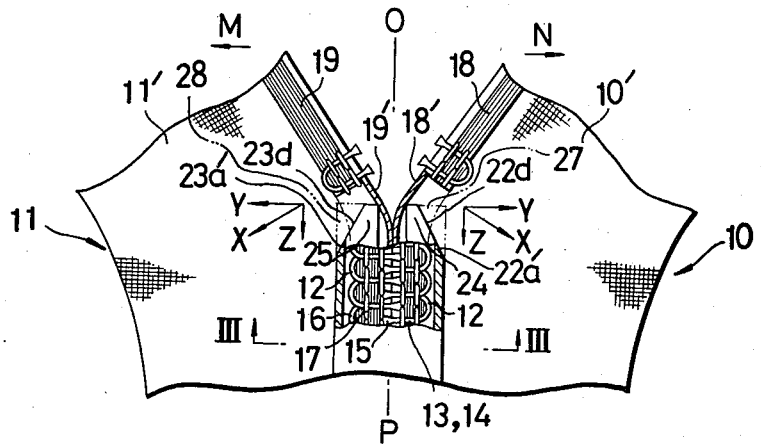
FIG. 2 is a fragmentary plan view of a pair of slide fastener stringers equipped with the retaining device of FIG. 1, the view being utilized to explain the function of the device.

Referring to the drawings and FIG. 2 in particular, there is shown a pair of slide fastener stringers 10, 11 each comprising a support tape 10', 11' and a row of fastener elements 12 attached thereto, the elements 12 being shown for purposes of illustration to be in the form of a continuous helically coiled structure. This structure when taken as an individual coupling element comprises an upper leg 13, a lower leg 14, a coupling head 15 merging into these leg portions and a connecting portion 16 remote from the coupling head 15 and interconnecting the element 12 to respective adjacent element. A longitudinally extending filler cord 17 is inserted in and through the space defined between the upper and lower legs 13 and 14 of the fastener element in a manner well known. Each support tape 10', 11' has an element-carrying edge 18, (19) inwardly folded on itself about a fold 18', (19') and adapted for mounting thereon the row of fastener elements 12, the arrangement being that when the two mating stringers 10, 11 are coupled together by a slider (not shown), the fastener elements 12 are completely masked or concealed from external view, only leaving a linear seam in the junction of the opposed tapes 10', 11'.

Figure 1:
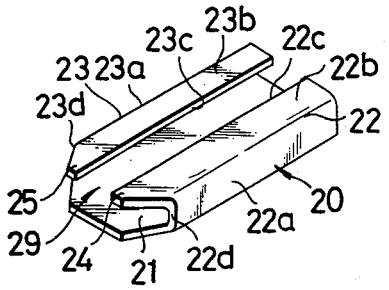
FIG. 1 is a perspective view of a retaining device formed in accordance with a preferred embodiment of the invention.

Referring now to FIG. 1, there is shown a retaining device 20 which comprises a base 21 and a pair of opposed, inwardly directed longitudinal flanges 22, 23, the base and the flanges defining therebetween a channel 29 functionally analogous to a channel of a standard form of slider for guiding therein the rows of fastener elements. This permits the retaining device 20 to move along the rows of fastener elements. The flanges 22, 23 each have a vertical side wall **22*a*, (23*a*) and a horizontal upper wall 22*b*, (23*b*) disposed substantially at right angles to said side wall and substantially in parallel with the plane of the base 21. The horizontal walls 22*b*, 23*b* have their longitudinal edges 22*c*, 23*c* disposed in spaced, confronting relationship, the distance therebetween corresponding substantially to a total thickness of the abutted folds 18', 19' of opposed fastener stringer tapes 10', 11', or being great enough to allow the edges 22*c*, 23*c* to move freely with respect to the folds 18', 19'**.

Figure 3:
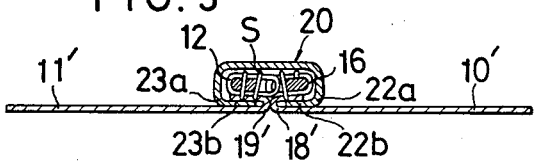
FIG. 3 is a sectional view taken on the line III — III of FIG. 2.

The retaining device 20 thus generally assumes the form of a casing of a geometry calculated to snugly encase or accommodate therein the mass of interengaged element-carrying edges 18, 19, except the folds 18', 19', of respective fastener stringers, as illustrated in FIGS. 2 and 3.

More specifically, the retaining device 20, as mounted on the fastener, has its side walls 22*a*, 23*a* facing the connecting portions 16 of interengaged fastener elements 12, its base portion 21 and its horizontal walls 22*b*, 23*b* facing the upper and lower legs 13, 14 respectively of each element row, with the sewing stitches S interposed between said base and said horizontal walls, as better illustrated in FIG. 3.

In one preferred form of retaining device 20 shown in FIG. 1, there are provided a pair of symmetrical projections 24, 25 integral with the horizontal walls 22*b*, 23*b* at least at one end of the device 20. Each projection is formed by cutting a portion of the flange 22, (23) away as at 22*d*, (23*d*) obliquely with respect to the longitudinal axis of the device 20, the cut-away portion 22*d*, (23*d*) being tapered off with the resulting projection 24, (25) extending ahead of or beyond the position of the portion 22*a*', (23*a*') of the side wall 22*a*, (23*a*) that has been cut and off-set.

The function of the retaining device 20 thus constructed will now be explained with reference to FIG. 2. The retaining device 20 is mounted at a terminal end portion of the concealed fastener stringers 10, 11 which have been coupled together, in which instance the tapered projections 24, 25 are directed toward an extremity of that end portion. Assuming that a force was applied to the terminal end of the fastener in the direction of the arrows M and N, i.e. in a direction to split the two stringers apart, it will be appreciated that had it not been for the projections 24, 25 of the retaining device 20; that is, if the flanges 22, 23 were coextensive throughout their length with the tip end of the projections 24, 25 as indicated by dot-and-dash lines 27, 28 in FIG. 2, the companion rows of fastener elements 12 would become disengaged or separated progressively toward the center of the fastener, because the connecting portions 16 would be brought into contact with the dot-and-dash line side wall portions 27, 28 prior to or simultaneously with the contacting of the projections 24, 25 with the folds 18', 19' of the stringer tapes 10', 11'. Whereas, in the presence of projections 24, 25 above described, such lateral stresses tend to force these projections 24, 25 against the folds 18', 19' of respective stringer tapes 10', 11' and apply thereto a pressure working in the direction of the arrow X. This pressure X results from the fact that a horizontal component force Y becomes greater than a vertical component force Z due to the fastener tape being a woven or knitted flexible fabric and hence a lateral pull is directed substantially at right angles to the longitudinal center axis O-P of the fastener. Therefore, the horizontal component force Y creates a friction between the stringer tapes 10, 11 and the retaining device 20, more specifically, between the projections 24, 25 and the tape folds 18', 19', the resulting frictional force being great enough to overcome the vertical component force Z, whereby the retaining device 20 can be retained in place with respect to the fastener.

Figure 5:
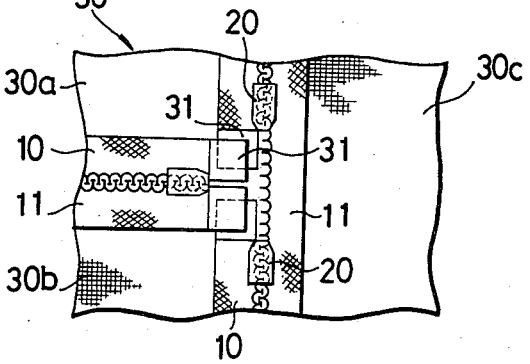
FIG. 5 is a plan view of a portion of a carpet to which a slide fastener equipped with the retaining device of the invention is applied.

FIG. 5 illustrates a typical example of application of the retaining device 20 of the invention, wherein there is shown a carpet 30 having a plurality of sections 30*a*, 30*b* and 30*c* joined together by concealed fastener stringers 10, 11. Designated at 31 is a reinforcing strip secured to an end portion of each stringer but separated from the carpet 30 for the purpose of mounting or dismounting the retaining device 20 with respect to the stringers 10, 11. FIG. 5 shows the view of the reverse side of the carpet 30 in which the sliders now shown have been removed from the fastener stringers 10, 11 so as to render the carpet surfaces flat and smooth as desired. The retaining device 20 has many other useful applications such as where artificial lawns are cojoined by slider-free fastener stringers, yet where severe lateral pull prevails.

Figure 4:
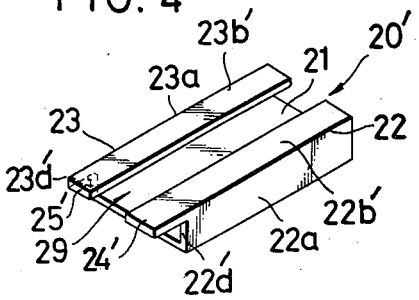
FIG. 4 is a perspective view of a modified form of retaining device provided in accordance with the invention.

There is shown in FIG. 4 a modification of retaining device 20' according to the invention, which is substantially identical with the embodiment already described in connection with FIGS. 1, 2 and 3, with the exception of the form of projections 24', 25' which are coextensive with the horizontal walls 22*b*', 23*b*' of the flanges 22, 23 but project beyond the edges cut-away or off-set portions 22*d*', 23*d*' which extend substantially at right angles to the longitudinal axis of the device 20'.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A retaining device for a concealed type slide fastener in which a pair of stringer tapes are each folded along a respective confronting longitudinal edge to define a fastener element-carrying portion of the stringer tape with a fold connection to the remainder of the stringer tape and disposed in overlying relation thereto, and a pair of rows of interengageable fastener elements are supported each row by a respective fastener element-carrying portion, which device comprises a base and a pair of opposed inwardly directed flanges connected to said base to define therewith a generally straight channel for receiving therethrough a lengthwise section of interengaged fastener elements and their associated fastener element-carrying portions of stringer tape, said flanges having respective first wall portions positioned each between a corresponding fastener element-carrying portion of stringer tape and the remainder of said stringer tape, said flanges having respective second wall portions connecting said first wall portions to said base and laterally confining said section of interengaged fastener elements, said first wall portions extending beyond said second wall portions to positions of engagement with said fold connections to restrain said interengaged fastener elements against separation by lateral forces applied to the stringer tapes.

2. A retaining device according to claim 1 wherein said first wall portions and the parts thereof that extend beyond said second wall portions also extend respectively along a pair of parallel longitudinal edges, the engagement with said fold connections being at locations on said edges.

3. A retaining device according to claim 1 wherein the parts of said first wall portions that extend beyond said second wall portions are tapered toward the fold connections.

4. A retaining device according to claim 1 wherein said first wall portions are generally parallel to each other and generally parallel to said base.

* * * * *